US009140515B2

(12) United States Patent
Yi et al.

(10) Patent No.: US 9,140,515 B2
(45) Date of Patent: Sep. 22, 2015

(54) COMPOUND BOW HAVING IMPROVED VIBRATION-DAMPING PERFORMANCE

(71) Applicant: WIN & WIN Co., Ltd., Gyeonggi-do (KR)

(72) Inventors: Chang Ho Yi, Incheon (KR); Dong Won Park, Seoul (KR); Ki Tae Han, Gyeonggi-do (KR)

(73) Assignee: WIN & WIN Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/589,229

(22) Filed: Jan. 5, 2015

(65) Prior Publication Data

US 2015/0192381 A1 Jul. 9, 2015

(30) Foreign Application Priority Data

Jan. 3, 2014 (KR) ..... 10-2014-0000868

(51) Int. Cl.
*F41B 5/20* (2006.01)
*F41B 5/14* (2006.01)
*F41B 5/10* (2006.01)

(52) U.S. Cl.
CPC ..... *F41B 5/1426* (2013.01); *F41B 5/10* (2013.01); *F41B 5/1407* (2013.01)

(58) Field of Classification Search
CPC ..... F41B 5/1426; F41B 5/1407; F41B 5/10
USPC ..... 124/25.6, 86, 88, 89, 90, 92
See application file for complete search history.

(56) References Cited

U.S. PATENT DOCUMENTS

| | | | | |
|---|---|---|---|---|
| 4,061,125 | A * | 12/1977 | Trotter | 124/23.1 |
| 4,461,267 | A * | 7/1984 | Simonds et al. | 124/25.6 |
| 4,628,892 | A * | 12/1986 | Windedahl et al. | 124/25.6 |
| 5,452,704 | A * | 9/1995 | Winebarger | 124/92 |
| 5,720,269 | A * | 2/1998 | Saunders | 124/86 |
| 6,532,945 | B1 * | 3/2003 | Chattin | 124/25.6 |
| 6,634,348 | B2 * | 10/2003 | Gallops, Jr. | 124/25.6 |
| 6,715,479 | B1 * | 4/2004 | Bunk | 124/25.6 |
| 6,904,900 | B2 * | 6/2005 | Gallops, Jr. | 124/25.6 |
| 6,966,314 | B2 * | 11/2005 | McPherson | 124/89 |
| 7,793,646 | B2 * | 9/2010 | Cooper et al. | 124/89 |
| 8,011,356 | B2 * | 9/2011 | Gordon et al. | 124/88 |
| 8,033,277 | B2 * | 10/2011 | Gordon et al. | 124/88 |
| 8,176,906 | B2 * | 5/2012 | Simo et al. | 124/25.6 |
| 8,272,374 | B2 * | 9/2012 | Cooper | 124/88 |
| 8,276,576 | B1 * | 10/2012 | Kuhn | 124/89 |

(Continued)

FOREIGN PATENT DOCUMENTS

KR 10-2010-0096555 A 9/2010

*Primary Examiner* — Alexander Niconovich
(74) *Attorney, Agent, or Firm* — Berenato & White, LLC

(57) ABSTRACT

A compound bow has an improved vibration damping function. The compound bow includes a bow main body including a handle and a pair of limbs; upper and lower pulley assemblies each including a pulley and a cam; a bowstring; first and second cam cables that are wound around the cam of each of the upper and lower pulley assemblies as the bowstring is pulled; a bowstring support bar whose one end is coupled to the handle and whose other end is coupled to a cushioning member that contacts the bowstring; and a first cam cable anti-vibration bar including a coupling bar coupled to the handle, and an anti-vibration member that is coupled to the rear end of the coupling bar and whose rear surface contacts one of the first and second cam cables when the bowstring is released to thus return to an original position.

7 Claims, 9 Drawing Sheets

(56) References Cited

U.S. PATENT DOCUMENTS

| | | | | |
|---|---|---|---|---|
| 8,402,960 | B2 * | 3/2013 | McPherson | 124/88 |
| 8,408,195 | B2 * | 4/2013 | McPherson | 124/86 |
| 8,453,636 | B2 * | 6/2013 | Gordon et al. | 124/88 |
| 8,522,767 | B1 * | 9/2013 | Kuhn | 124/89 |
| 8,567,381 | B2 * | 10/2013 | Saunders | 124/88 |
| 8,646,440 | B1 * | 2/2014 | Albanese et al. | 124/88 |
| 8,820,304 | B2 * | 9/2014 | Batdorf | 124/25.6 |
| 8,869,785 | B2 * | 10/2014 | Bidigare et al. | 124/89 |
| 8,978,636 | B2 * | 3/2015 | Bednar et al. | 124/89 |
| 9,046,317 | B2 * | 6/2015 | McPherson | 1/1 |
| 2003/0056779 | A1 * | 3/2003 | Gallops, Jr. | 124/89 |
| 2006/0011181 | A1 * | 1/2006 | Andrews | 124/23.1 |
| 2009/0071458 | A1 * | 3/2009 | Gordon et al. | 124/25.6 |
| 2009/0133683 | A1 * | 5/2009 | Wright | 124/89 |
| 2011/0011385 | A1 * | 1/2011 | Grace et al. | 124/25.6 |
| 2011/0073090 | A1 * | 3/2011 | McPherson | 124/25.6 |
| 2012/0042861 | A1 * | 2/2012 | Anselmo | 124/25.6 |
| 2013/0047972 | A1 * | 2/2013 | Walk et al. | 124/25.6 |
| 2013/0174825 | A1 * | 7/2013 | Bednar et al. | 124/88 |
| 2014/0014083 | A1 * | 1/2014 | Saunders | 124/88 |
| 2014/0060514 | A1 * | 3/2014 | Bidigare et al. | 124/88 |
| 2014/0116408 | A1 * | 5/2014 | McPherson | 124/25.6 |

* cited by examiner

COMPOUND BOW HAVING IMPROVED VIBRATION-DAMPING PERFORMANCE

CROSS-REFERENCE TO RELATED APPLICATION

This application claims the benefit of Korean Patent Application No. 10-2014-0000868, filed on Jan. 3, 2014, in the Korean Intellectual Property Office, the disclosure of which is incorporated in its entirety herein by reference and to which priority is claimed.

BACKGROUND OF THE INVENTION

1. Field of the Invention

The present invention relates to a compound bow, and more particularly, to a compound bow which can damp vibrations that are generated in a handle to thus improve accuracy of an arrow when a bowstring is pulled.

2. Description of the Related Art

Typically, compound bows are configured so that a bowstring may be easily pulled without using a large force and arrow-shooting power is increased during shooting, by using an effect of a cam or wheel, to thus result in a fast speed of an arrow with very strong power, and are widely used mainly for hunting.

As shown in FIG. 1, a conventional compound bow is configured to have an upper limb 20 that is coupled to the upper portion of a handle 10 at the center of which a grip portion is formed, and lower limb 26 coupled to the lower portion of the handle 10. A cut-out portion is formed between the upper limb 20 whose edges are spaced apart from each other, and a cut-out portion is formed between the lower limb 26 whose edges are spaced apart from each other. Rotating shafts 70 are formed through the edges of the upper limb 20 and the cut-out portion, and through the edges of the lower limb 26 and the cut-out portion, respectively. Upper and lower pulleys 30 and 36 are rotatably combined with the respective rotating shafts 70.

A guide groove is formed on the outer circumferential surface of each pulley 30 or 36. A bowstring 50 is wound along the guide groove of each pulley 30 or 36, and the respective ends of the bowstring 50 are combined with each pulley 30 or 36. In addition, a cam 32 or 38 rotating with the pulley 30 or 36 is coupled in each pulley 30 or 36. As the bowstring 50 is pulled, cam cables 40 and 46 are formed between both the pulleys 30 and 36 so as to be wound on the cams 32 and 38, respectively.

Further, a cable guard 60 is laterally mounted at one side of a center portion of a handle 10, in which the cable guard 60 pushes the cam cables 40 and 46 to one side of the bowstring 50 so that an arrow is not prevented from being shot during shooting.

When the bowstring 50 is pulled in the prior art compound bow that is configured as described above, the lower and upper pulleys 30 and 36 are rotated and thus the cams 32 and 38 coupled to the lower and upper pulleys 30 and 36 are rotated, to thereby wind and pull the cam cables 40 and 46. When the bowstring 50 is released in a let-off state, an arrow obtains a strong driving force while the bowstring 50 returns to an original position instantaneously by a strong elastic force of the bow.

As described above, while the bowstring 50 returns to an original position when the arrow is shot, vibrations are generated from the bowstring 50 that is formed between the pulleys 30 and 36. Such vibrations are ultimately transferred to the handle 10 to thereby cause a problem that degrades the accuracy of the arrow. Thus, as shown in FIG. 1, in order to solve such a problem, a bowstring support bar for supporting the bowstring 50 is provided at the lower side of the handle 10. One end of the bowstring support bar 80 is coupled to the lower side of the handle 10, and the other end thereof is bonded to a contact rubber 81 that supports in contact with the bowstring 50. When the bowstring 50 returns to an original position at a let-off state, that is, at a firing state, the bowstring 50 is in contact with the contact rubber 81 of the bowstring support bar 80, thereby damping the vibrations of the bowstring 50. Thus, such vibrations generated from the bowstring 50 can be attenuated to some extent even in the case of the compound bow of FIG. 1. However, vibrations transmitted to the handle 10 cannot be removed satisfactorily so that a user can hardly feel the vibrations.

SUMMARY OF THE INVENTION

To solve the above conventional problems or defects, it is an object of the present invention to provide a compound bow which can greatly damp vibrations that are generated in a handle to thus further improve accuracy of an arrow.

For this purpose, according to previous studies of damping vibrations transmitted to a handle in the case of existing compound bows, the vibrations transmitted to a handle have been attenuated by reducing vibrations of a bowstring that is in direct contact with an arrow and is pulled by a user with a large displacement. However, the present inventors have carried out a constant research of damping vibrations of the compound bow to accordingly improve the accuracy of the arrow, beyond the previous studies, and thus have found that cam cables that are not in direct contact with the arrow generate vibrations to a handle, to thereby provide a new compound bow which can attenuate vibrations generated from the handle by damping the vibrations generated from the cam cables.

To accomplish the above and other objects of the present invention, according to an aspect of the present invention, there is provided a compound bow having an improved vibration damping function, the compound bow comprising: a bow main body including a handle at a central portion of which a grip portion is formed and a pair of limbs that are respectively coupled to both ends of the handle; upper and lower pulley assemblies each including a pulley that is rotatably coupled to a rotating shaft formed on the rear end of each limb, and a cam that is coupled to one side of the pulley and is rotated with the pulley; a bowstring whose either end is wound and coupled onto the pulley of each of the upper and lower pulley assemblies; first and second cam cables that are wound around the cam of each of the upper and lower pulley assemblies as the bowstring is pulled, in which one end of each of the first and second cam cables is coupled to one of the upper and lower pulley assemblies, and the other end thereof is coupled to the other of the upper and lower pulley assemblies or the rotating shaft of the other of the upper and lower pulley assemblies; a bowstring support bar whose one end is coupled to the handle and whose other end is coupled to a cushioning member that contacts the bowstring; and a first cam cable anti-vibration bar including a coupling bar coupled to the handle, and an anti-vibration member that is coupled to the rear end of the coupling bar and whose rear surface contacts one of the first and second cam cables when the bowstring is released to thus return to an original position.

Preferably but not necessarily, the first cam cable anti-vibration bar further comprises a pivot lever whose one end is pivotally coupled to the handle and whose other end is coupled to the coupling bar.

Preferably but not necessarily, the first cam cable anti-vibration bar is coupled to the bowstring support bar.

Preferably but not necessarily, the first cam cable anti-vibration bar further comprises a pivot lever whose one end is pivotally coupled to the bowstring support bar and whose other end is coupled to the coupling bar.

Preferably but not necessarily, a seating groove into which the first cam cable is seated is formed at the rear surface of the anti-vibration member of the first cam cable anti-vibration bar.

Preferably but not necessarily, the anti-vibration member of the first cam cable anti-vibration bar is made of rubber in which the anti-vibration member contacts the first cam cable.

Preferably but not necessarily, the compound bow further comprises: a second cam cable anti-vibration bar including a connection bar coupled to the handle, and an anti-vibration member that is coupled to the rear end of the connection bar and whose rear surface contacts the other of the first and second cam cables when the bowstring is released to thus return to an original position.

Preferably but not necessarily, the second cam cable anti-vibration bar is configured so that the connection bar is coupled to the first cam cable anti-vibration bar.

Preferably but not necessarily, the second cam cable anti-vibration bar is coupled to the upper side of the handle, the first cam cable anti-vibration bar is coupled to the lower side of the handle, to thus enable the second cam cable anti-vibration bar to damp vibrations of the second cam cable wound around the cam of the upper pulley assembly and the first cam cable anti-vibration bar to damp vibrations of the first cam cable wound around the cam of the lower pulley assembly.

According to another aspect of the present invention, there is provided a compound bow having an improved vibration damping function, the compound bow comprising: a bow main body including a handle at a central portion of which a grip portion is formed and a pair of limbs that are respectively coupled to both ends of the handle; a main pulley that is rotatably coupled to a rotating shaft that is formed at the rear end of one of the pair of limbs; a driven pulley that is rotatably coupled to a rotating shaft that is formed at the rear end of the other of the pair of limbs; a bowstring whose one end is coupled to one side of the main pulley and is wound around the main pulley, and whose other end is wound on a cable winder that is formed in the main pulley in a state where a middle portion of the bowstring is wound on the driven pulley, to thus enable the end of the bowstring to be coupled to the main pulley; a cam cable that is wound on a cam that is formed at one side of the main pulley and is rotated with the main pulley when the bowstring is pulled, in which one end of the cam cable is coupled to the rear end of the limb to which the driven pulley is coupled and the other end thereof is coupled to the main pulley; a first bowstring support bar whose one end is coupled to the handle and whose other end is coupled to a cushioning member that contacts a part of the bowstring pulled for firing an arrow; and a cam cable anti-vibration bar including a coupling bar coupled to the handle, and an anti-vibration member that is coupled to the rear end of the coupling bar and whose rear surface contacts the cam cable when the bowstring is released to thus return to an original position.

Preferably but not necessarily, the compound bow further comprises a second bowstring support bar including a connection bar coupled to the handle, and an anti-vibration member whose rear surface contacts a part of the bowstring that is extended toward the driven pulley from the cable winder when the bowstring is released to thus return to an original position.

Advantageous Effects

As described above, the present invention provides a compound bow which can greatly damp vibrations that are generated in a handle to thus further improve accuracy of an arrow.

DETAILED DESCRIPTION OF THE INVENTION

The above and/or other objects and/or advantages of the present invention will become more apparent by the following description of embodiments of the present invention.

Hereinbelow, a compound bow having improved vibration-damping performance according to embodiments of the present invention will be described in more detail with reference to the accompanying drawings.

Figure 1:
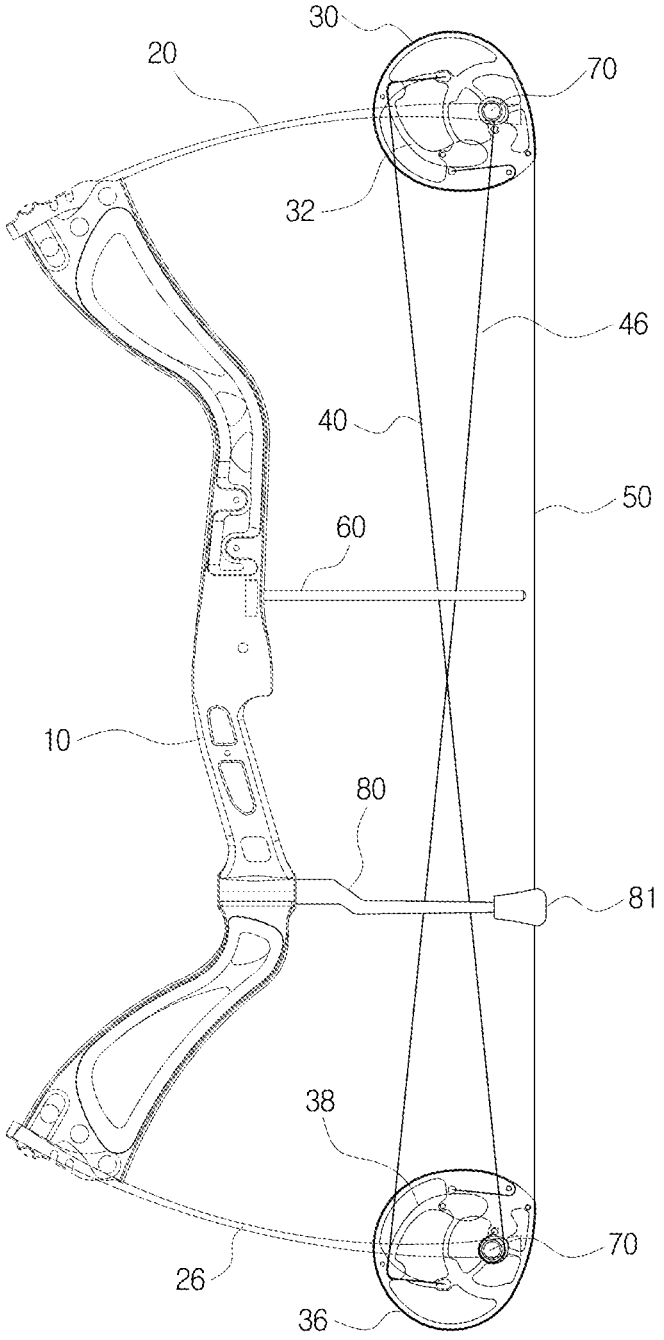
FIG.1 (PRIOR ART)
FIG. 1 is a side view of a conventional compound bow.
Figure 2:
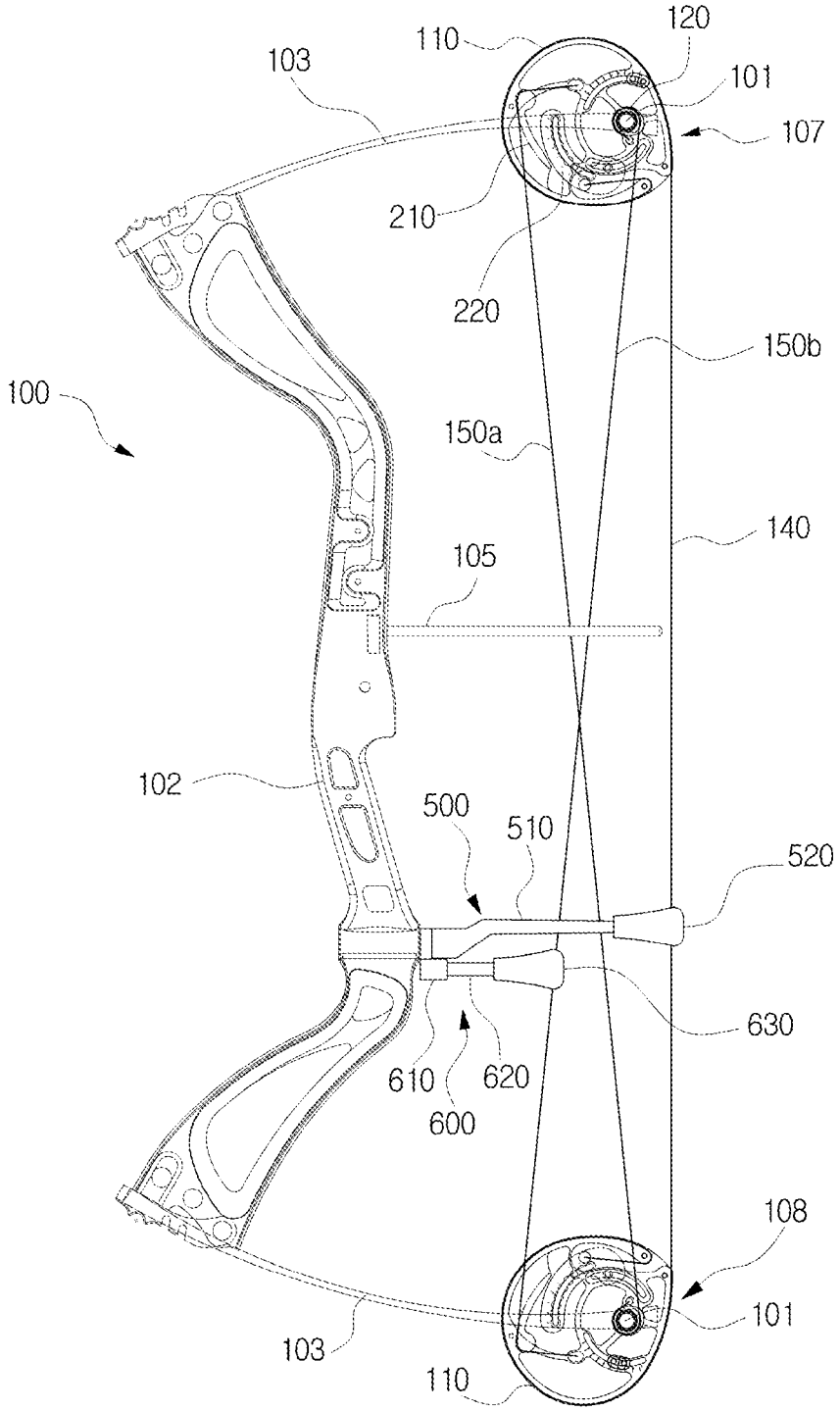
FIG. 2 is a side view showing a compound bow according to a first embodiment of the present invention.
Figure 3:
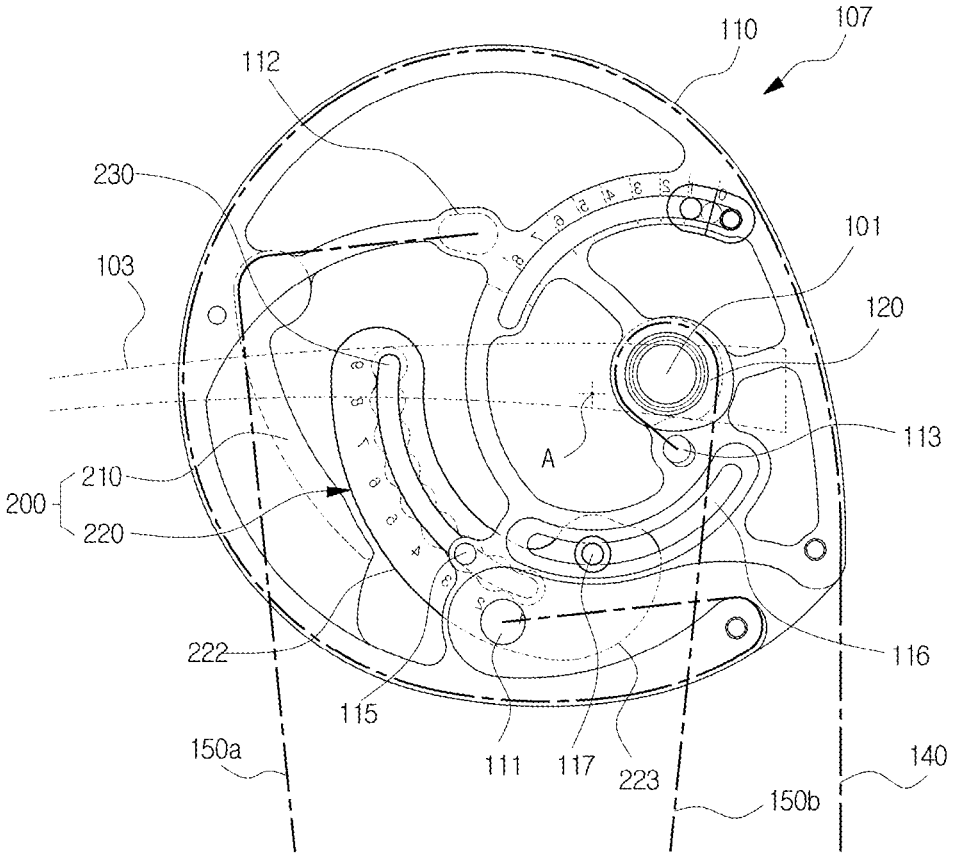
FIG. 3 is a detailed view of a pulley assembly that is coupled to one of limbs in FIG. 2.
Figure 4:
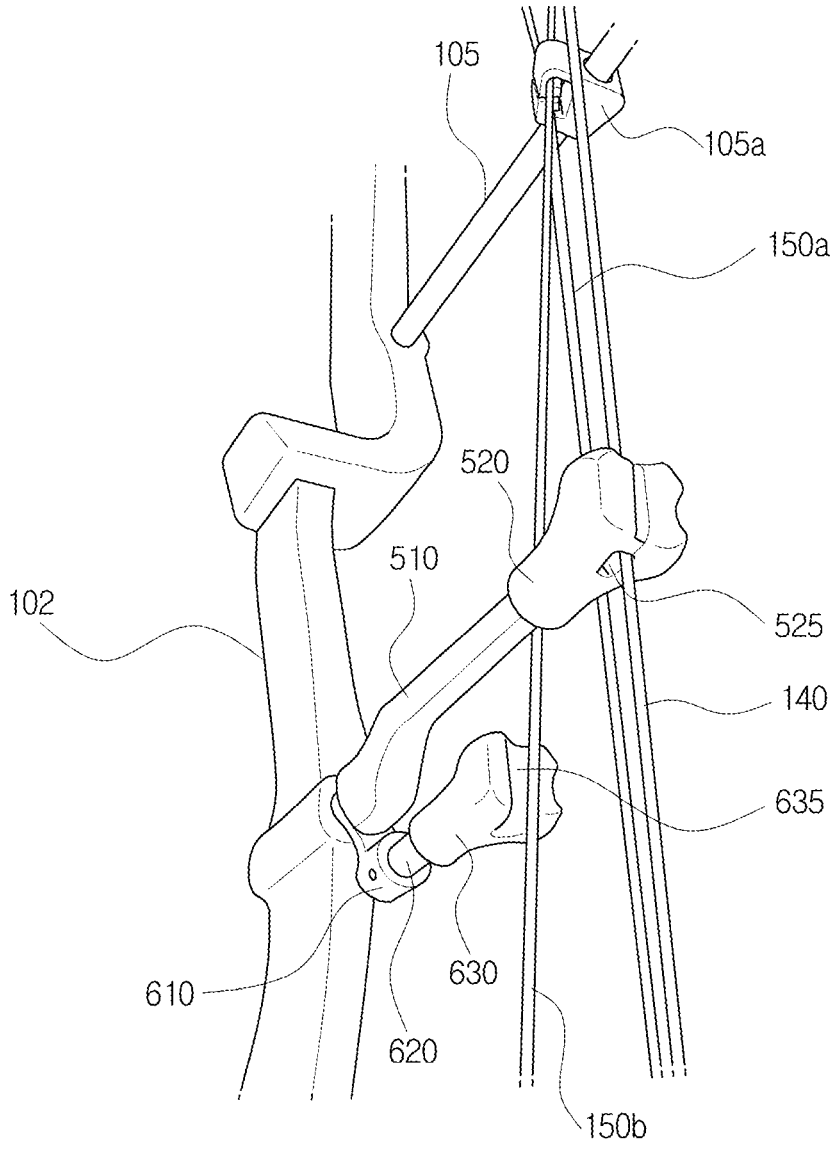
FIG. 4 is a perspective view showing a part of a compound bow according to the first embodiment of the present invention.
Figure 5:
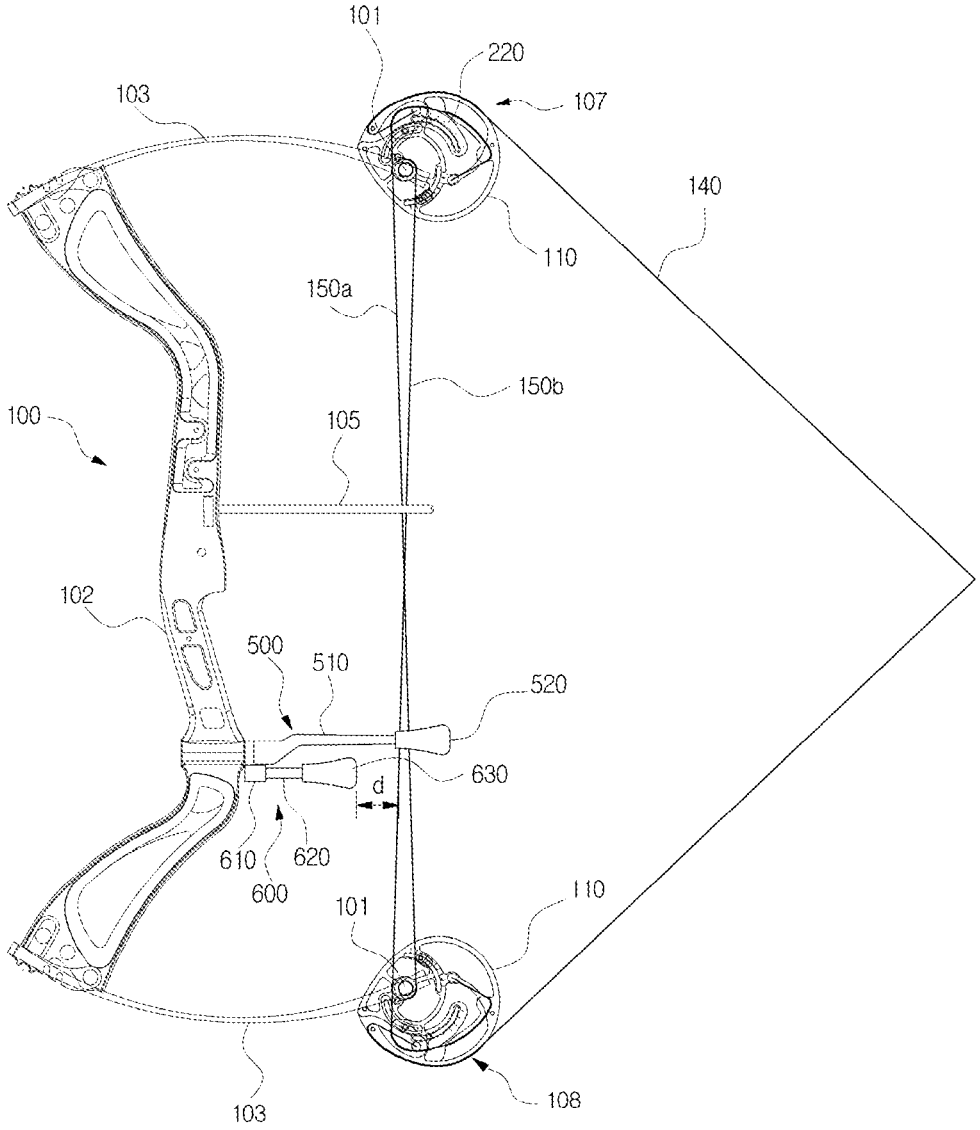
FIG. 5 is a side view showing a compound bow according to the first embodiment of the present invention after a bowstring has been pulled.

FIG. 2 is a side view showing a compound bow according to a first embodiment of the present invention. FIG. 3 is a detailed view of a pulley assembly that is coupled to one of limbs in FIG. 2. FIG. 4 is a perspective view showing a part of a compound bow according to the first embodiment of the present invention. FIG. 5 is a side view showing a compound bow according to the first embodiment of the present invention after a bowstring has been pulled.

Referring to FIGS. 2 to 5, a compound bow having improved vibration-damping performance according to a first embodiment of the present invention includes: a bow main body 100 including a pair of limbs 103 that are respectively coupled to both ends of a handle 102; upper and lower pulley assemblies 107 and 108 each including a pulley that is rotatably coupled to the rear end of each limb 103; a bowstring 140 whose either end is wound and coupled onto the pulley of each of the upper and lower pulley assemblies; first and second cam cables 150*a* and 150*b* that are wound around a cam 200 of each of the upper and lower pulley assemblies 107 and 108 as the bowstring is pulled; a cable guard 105; a bowstring support bar 500 that is coupled to the handle 102; and a first cam cable anti-vibration bar 600.

As shown in FIGS. 2 to 5, the compound bow according to the first embodiment of the present invention employs a dual-cam mode, each element of which will follow. The bow main body 100 includes the handle 102 at a central portion of which a grip portion is formed and a pair of limbs 103 that are respectively coupled to both ends of the handle 102, in which two branches are formed at a rear end of each of the limbs 103. A rotating shaft 101 is formed on the rear end of each limb 103 in which upper and lower pulley assemblies 107 and 108 are rotatably coupled to the rotating shafts 101, respectively, between the two branches at the rear end of the limbs 103. In addition, Further, a cable guard 105 is coupled to the handle 102 in which the cable guard 105 pushes the first and second cam cables 150*a* and 150*b* to one side of the grip portion of the bowstring 140 so that an arrow is not interfered from being fired at the upper side of the grip portion. A slide 105*a* is provided at the cable guard 105, in which the first and second cam cables 150*a* and 150*b* are inserted into the slide 105*a* and are movable through the slide 105*a*.

In addition, the upper and lower pulley assemblies 107 and 108 are rotatably coupled to the rotating shafts 101, respectively, at the rear end of the limbs 103. The upper and lower pulley assemblies 107 and 108 are symmetrically identical to each other in view of the structure, and each of the upper and lower pulley assemblies 107 and 108 includes: a pulley 110 that is rotatably coupled to the rotating shaft 101 formed on the rear end of each limb 103, and a cam 200 that is coupled to one side of the pulley 110 and is rotated with the pulley 110.

Each pulley 110 is formed of an oval-like plate-shaped member, and has an eccentric through-hole that is formed at the center of the pulley 110 and through which the rotating shaft 101 is coupled. Further, a guide groove that is depressed down to a predetermined depth is formed on the outer circumferential surface of each pulley 110 so that the bowstring 140 may be wound on the outer circumferential surface of each pulley 110. A fixing protrusion 111 for fixing one end of the bowstring 140 wound on the guide groove is formed at one side of each pulley 110. In addition, fixing protrusions 112 and 113 are formed in each pulley 110 in which the cam cables 150*a* and 150*b* are fixed to the fixing protrusions 112 and 113, respectively.

The cam 200 is formed in each pulley 110 and is rotated with rotation of the pulley 110, and includes: a cam cable winding portion 210 fabricated in an arc-shaped form and on which one of the cam cables 150*a* and 150*b* is wound; and a cam module 220 that is rotatably coupled by a predetermined angle from the cam cable winding portion 210, around a pivot point "A" at a position spaced by a predetermined distance from the rotating shaft 101 of the pulley 110 to which the cam 200 is coupled, in which a cam cable winding groove is formed on the outer circumferential surface of the cam module 220, and the one of the cam cables 150*a* and 150*b* is wound around the cam cable winding portion 210 and then sequentially wound on the outer circumferential surface of the cam module 220 when the bowstring 140 is pulled.

In addition, the cam 200 further includes a fixing unit that makes the cam module 220 rotated by a predetermined angle with respect to the pivot point "A" in order to control a draw length of the let-off state of the compound bow, and that makes the cam module 220 fixed to the pulley 110 at a position where the cam module 220 has been rotated.

The cam cable winding portion 210 is arc-shaped so that the cam cables 150*a* and 150*b* are wound on the cam cable winding portion 210, when the bowstring 140 is pulled, in which the cam cables 150*a* and 150*b* are respectively coupled to the fixing protrusions 112 and 113 that are located in the vicinity of the cam cable winding portion 210. In addition, a cam cable winding groove is formed on the outer circumferential surface of the cam cable winding portion 210 so that one of the cam cables 150*a* and 150*b* is wound on the outer circumferential surface of the cam cable winding portion 210.

The cam module 220 is rotatably coupled to the pulley 110 around the pivot point "A" at a position spaced by a predetermined distance from the rotating shaft 101 of the pulley 110 to which the cam 200 is coupled, and is configured to have a gentle slope portion 222 formed of a gentle arc-shaped curve and a steep slope portion 223 that is extended from the gentle slope portion 222 to be close to the rotating shaft 101, to thus form a steep slope. Further, the cam cable winding grooves on which the cam cables 150*a* and 150*b* are wound are formed on the outer circumferential surfaces of the gentle slope portion 222 and the steep slope portion 223. Accordingly, the cam module 220 is rotated along with the pulley 110 when the bowstring 140 is pulled, and thus the cam cables 150*a* and 150*b* are sequentially wound on the gentle slope portion 222 and the steep slope portion 223 of the cam module 220 adjacent to the cam cable winding portion 210.

The fixing unit makes the cam module 220 rotated by a predetermined angle around the pivot point "A," and makes the cam module 220 fixed to the pulley 110 at a position where the cam module 220 has been rotated. To this end, an arc-shaped positioning hole 230 centered at the pivot point "A" is formed in the cam module 220, and a coupling hole (not shown) is formed in the pulley 110 to which the cam module 220 is coupled. Thus, when the cam module 220 is rotated by a predetermined angle around the pivot point "A", and a coupling member 115 is coupled to the coupling hole (not shown) formed in the pulley 110 at a predetermined position of the positioning hole 230, the cam module 220 is coupled to the pulley 110. In the present invention, when a bolt as the coupling member 115 is inserted into the positioning hole 230 and is screw-coupled into the coupling hole (not shown) formed in the pulley 110, the cam module 220 is coupled to the pulley 110. In addition, as the fixing unit, an arc-shaped coupling hole 116 centered at the pivot point "A" is additionally formed in the pulley 110, like the arc-shaped positioning hole 230, and a bolt 117 is coupled to a bolt hole formed at a predetermined position of the cam module 220. Since the bolt 117 passes through the arc-shaped coupling hole 116 formed in the pulley 110 and then one end of the bolt 117 is coupled to a nut, the cam module 220 is additionally fixed to the pulley 110.

In addition, a position indicator indicated by numbers are provided around the positioning hole 230, in order to indicate positions at which the cam module 220 is fixed. The cam modules 220 that are respectively coupled to the upper and lower pulley assemblies 107 and 108 should have an identical rotational angle, and thus a position indicator is indicated by numbers so as to see the rotational angle of each cam module 220. Of course, the position indicator may be indicated by alphabetical letters instead of Arabic numbers.

The cam module 220 having such a structure in the present invention can adjust the draw length of the bowstring 140. Thus, when the cam module 220 of each of the upper and lower pulley assemblies 107 and 108 is identically rotated by an identical angle from the cam cable winding portion 210 around the pivot point "A" and the cam module 220 is again secured to the pulley 110 at a position where the cam module 220 has been rotated, the length of one of the cam cables 150*a* and 150*b* that is wound on the gentle slope portion 222 of the cam module 220 increases in comparison with the previous embodiment. At last, the length of one of the cam cables 150*a* and 150*b* that is wound from the cam cable winding portion 210 to the cam module 220 until the let-off state increases, to thereby increase the draw length of the bowstring 140.

The bowstring 140 is wound in the guide groove of the pulley 110 of each pulley assembly 107 or 108 and thus both ends of the bowstring 140 are coupled to the fixing protrusions 111 formed on the respective pulleys 110.

The first and second cam cables 150*a* and 150*b* are formed between a pair of the limbs 103 of the bow main body 100 and are wound on the cams 200 formed in the respective pulleys 110, as the bowstring 140 is pulled. One end of each of the cam cables 150*a* and 150*b* is coupled to the fixing protrusion 113 formed on the pulley 110 of one of the pulley assemblies 107 and 108, and then is wound around the rotating wheel 120 that is rotatably coupled to the rotating shaft 101, to then be extended toward the other one of the pulley assemblies 107 and 108, and the other end of each of the cam cables 150*a* and 150*b* is fixed to the fixing protrusion 112 of the pulley 110 of the other one of the pulley assemblies 107 and 108. Therefore, as the bowstring 140 is pulled, the cam cables 150*a* and 150*b* are wound on the cam 200 that is coupled to the other pulley 110 of the pulley assemblies 107 and 108.

The rotating wheel 120 is configured to have a through-hole at the center of the rotating wheel 120 in which the rotating shaft 101 of the pulley 110 is coupled into the through-hole, and is configured to be coupled to the rotating shaft 101 of the pulley 110 and to be rotatably coupled to the rotating shaft 101 of the pulley 110 separately from the pulley 110. Further, the cam cable winding groove into which the cam cables 150*a* and 150*b* are wound is formed on the outer circumferential surface of the circular rotating wheel 120. Thus, the cam cables 150*a* and 150*b* are wound on the rotating wheel 120 and then one end of one of the cam cables 150*a* and 150*b* is coupled to the fixing protrusion 113 formed on the pulley 110 in the vicinity of the rotating wheel 120. The cam cables 150*a* and 150*b* are wound on the cam 200 of the other pulley 110 by the pulling of the bowstring 140, and accordingly a portion of the cam cables 150*a* and 150*b* wound on the rotating wheel 120 is released from the rotating wheel 120. Here, since the rotating wheel 120 is rotatably coupled to the rotating shaft 101 separately from the pulley 110, friction between each of the cam cables 150*a* and 150*b* and the rotating wheel 120 is reduced to thus reduce the pulling force of the bowstring 140.

The bowstring support bar 500 is coupled to the lower side of the grip portion of the handle 102 and contacts the bowstring 140, in which one end of the bowstring support bar 500 is coupled to the lower side of the grip portion of the handle 102 and the other end thereof is coupled to a cushioning member 520 that is made of rubber and that contacts the bowstring 140. In this embodiment, the bowstring support bar 500 includes: a support bar member 510 that is coupled to the handle 102; and the cushioning member 520 that is coupled to the support bar members 510, in which a support groove 525 is formed in the longitudinal direction at the rear end of the cushioning member 520, in which the bowstring 140 is inserted through the support groove 525 when the bowstring 140 is released and returns to an original position.

The first cam cable anti-vibration bar 600 is coupled to the lower side of the grip portion of the handle 102, and supports the first cam cable 150*b* when the bowstring 140 is released and returns to the original position, and includes: a pivot lever 610 one end of which is rotatably coupled to the bowstring support bar 500 and the other end of which is coupled to a coupling bar 620; the coupling bar 620 that is coupled to the other end of the pivot lever 610; and an anti-vibration member 630 that is coupled to the rear end of the coupling bar 620, in which the rear surface of anti-vibration member 630 contacts the first cam cable 150*b* of the two cam cables 150*a* and 150*b*, when the bowstring 140 is released and returns to an original position. A throughhole (not shown) is formed at one end of the pivot lever 610, so that the first cam cable anti-vibration bar 600 is rotatably coupled to the bowstring support bar 500, in which the front end of the bowstring support bar 500 is inserted into the throughhole (not shown). The pivot lever 610 is made to be rotated by a predetermined angle around the bowstring support bar 500, and then a portion of the pivot lever 610 to which the bowstring support bar 500 is coupled is fixed by using a fastening unit such as a bolt from the pivot lever 610. In addition, a seating groove 635 in which the first cam cable 150*b* is seated is formed at the back of the anti-vibration member 630 made of rubber.

The first cam cable anti-vibration bar 600 is rotatably coupled to the bowstring support bar 500 in the present invention. Accordingly, even if the position of the first cam cable 150*b* varies, the first cam cable anti-vibration bar 600 is made to be rotated depending upon the varied position of the first cam cable 150*b*, to thereby provide an advantage capable of adjusting the position of the first cam cable anti-vibration bar 600. As shown in FIG. 4, the slide 105*a* is coupled to the cable guard 105 in which the cam cables 150*a* and 150*b* are inserted into the slide 105*a*, and the slide 105*a* moves along the cable guard 105. The positions of the cam cables 150*a* and 150*b* can vary depending on the shape of the slide 105*a*. As described above, even in the case the positions of the cam cables 150*a* and 150*b* vary, it is possible to adjust position of the first cam cable anti-vibration bar 600 depending upon the varied positions of the cam cables 150*a* and 150*b*.

Meanwhile, an example in which the first cam cable anti-vibration bar 600 is coupled to the bowstring support bar 500 has been shown in this embodiment, but the pivot lever 610 may be rotatably coupled to the handle 102 as another example, or the coupling bar 620 may be coupled to the handle 102 without the pivot lever 610 as still another example.

Hereinafter, the operation of the compound bow that has an improved vibration damping function according to the first embodiment of the present invention will be described.

The state of the compound bow according to the present invention before the bowstring 140 is pulled is shown in FIGS. 2 to 4. If an arrow is mounted on an arrow holder (not shown) of the handle 102 in this state and the bowstring 140 is pulled, each of the pulleys 110 is rotated and accordingly the cam cables 150*a* and 150*b* wound on the rotating wheels 120 are released from the rotating wheels 120, to then be respectively wound on the cam 200 coupled to the other pulley 110 opposing each other. In addition, when the cam cables 150*a* and 150*b* are respectively wound on the steep slope portion 223 of the cam module 220 coupled to the other pulley 110 opposing each other, the compound bow becomes a let-off state at which an arrow can be shot as shown in FIG. 5.

When the bowstring 140 is released in this state, the bowstring 140 returns to the original position by a strong elastic force of the compound bow and thus the arrow gains a strong momentum so as to be shot. Here, when the bowstring 140 returns to the original position, the vibrations were generated from the bowstring 140 formed between the two pulleys 110, but the bowstring 140 contacts the rear surface of the bowstring support bar 500 when the bowstring 140 returns to the original position, to thereby cancel the vibrations. Simultaneously, when the first cam cable 150*b* is wound on the steep slope portion 223 of the cam module 220 that approaches closer to the rotating shaft 101 at the firing state as described above, the first cam cable 150*b* is retracted by a certain distance "d" from the original position as shown in FIG. 5 and when the bowstring 140 is released, the first cam cable 150*b* is advanced to generate vibrations, but when the first cam cable 150*b* returns to the original position, the first cam cable 150*b* is supported on the rear surface of the first cam cable anti-vibration bar 600, to thereby be capable of damping vibrations generated from the first cam cable 150*b*.

Thus, the present inventors have carried out a constant research of damping vibrations of the compound bow to accordingly improve the accuracy of the arrow, beyond the previous studies of damping vibrations transmitted to a handle in the case of existing compound bows, by reducing vibrations of a bowstring that is in direct contact with an arrow, and thus have found that cam cables that are not in direct contact with the arrow generate vibrations to a handle, to thereby provide a new compound bow which can attenuate vibrations generated from the handle by damping the vibrations generated from the cam cables.

Figure 6:
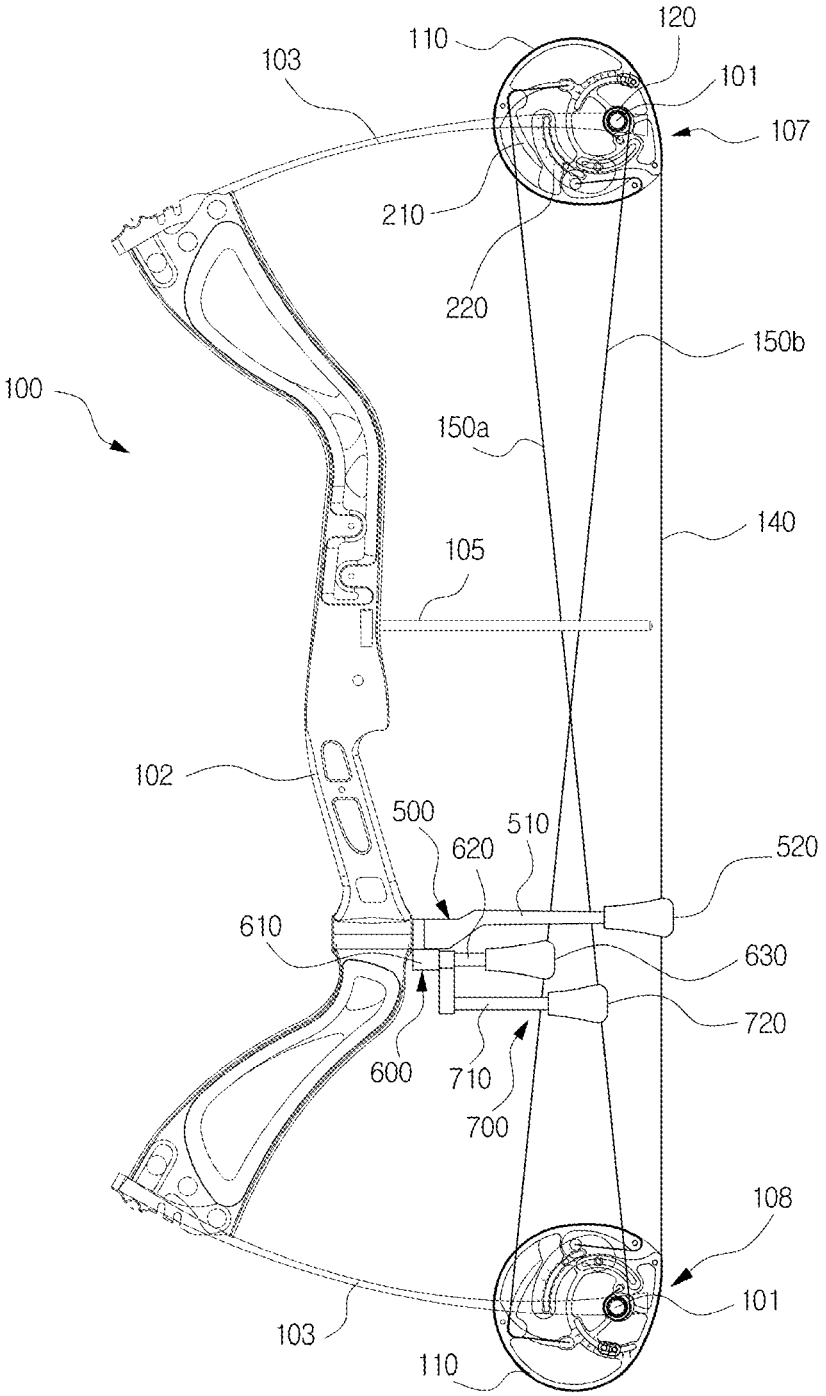
FIG. 6 is a side view showing a compound bow according to a second embodiment of the present invention.

Next, a compound bow according to a second embodiment of the present invention will be described. FIG. 6 is a side view showing a compound bow according to a second embodiment of the present invention. As shown in FIG. 6, the compound bow according to the second embodiment of the present invention is further provided with a second cam cable anti-vibration bar 700 in addition to the configuration of the first embodiment. The second cam cable anti-vibration bar 700 supports the second cam cable 150*a* when the bowstring 140 is released and returns to its original position, and includes: a connection bar 710 coupled to the coupling bar 620 of the first cam cable anti-vibration bar 600; and an anti-vibration member 720 that is coupled to the rear end of the connection bar 710 and whose rear surface contacts the second cam cable 150*a* of the two cam cables 150*a* and 150*b* when the bowstring 140 is released and returns to the original position. The compound bow according to the second embodiment has an effect capable of damping the vibrations of the second cam cable 150*a* as well as damping of the first cam cable 150*b* by further comprising the second cam cable anti-vibration bar 700. Other configuration and effects of the second embodiment are the same as those of the first embodiment and thus a detailed description thereof will be omitted here.

Figure 7:
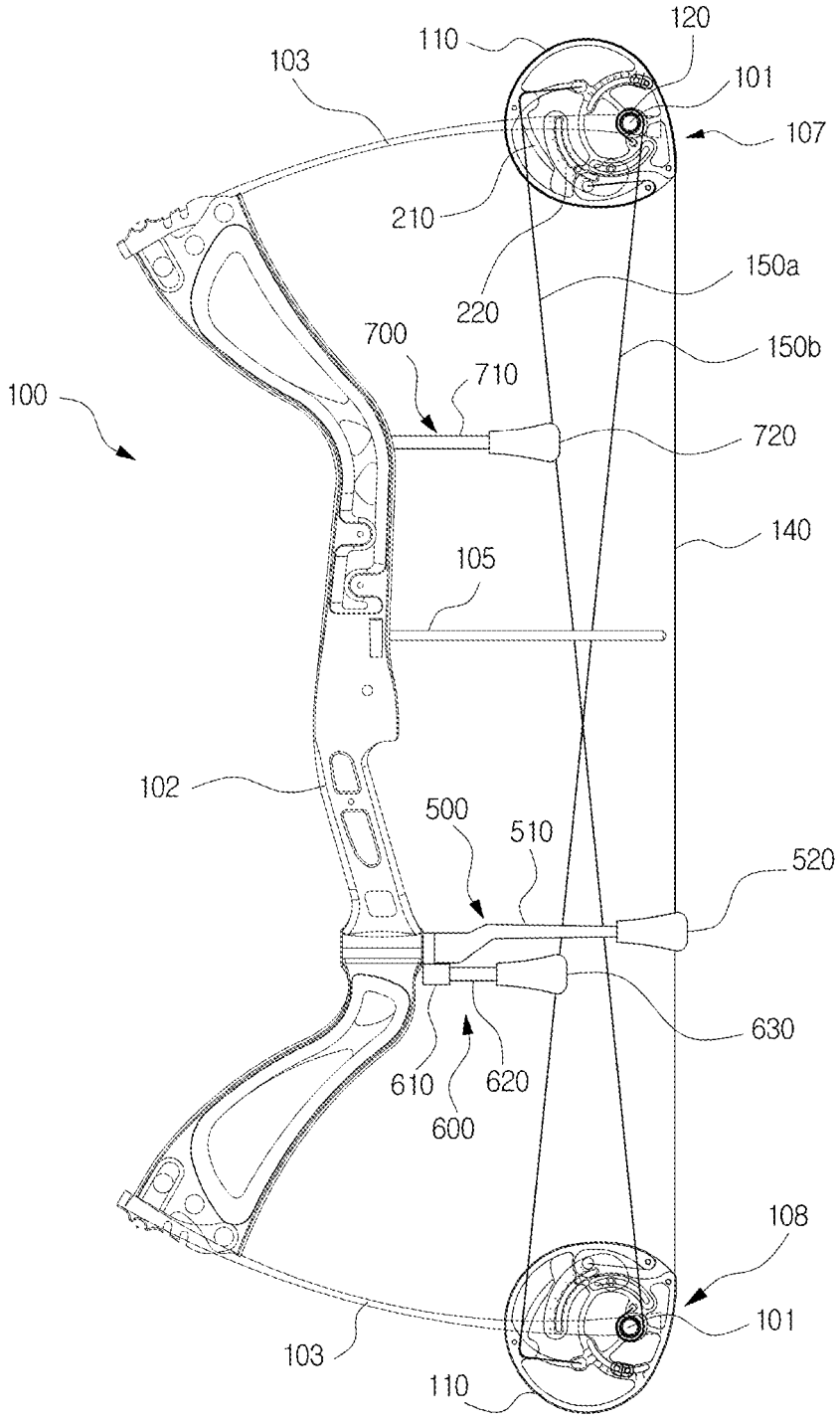
FIG. 7 is a side view showing a compound bow according to a third embodiment of the present invention.

Next, FIG. 7 is a side view showing a compound bow according to a third embodiment of the present invention. As shown in FIG. 7, in this embodiment, the second cam cable anti-vibration bar 700 is coupled to the upper portion of the grip portion of the handle 102 unlike the second embodiment. The connection bar 710 of the second cam cable anti-vibration 700 is coupled to the upper portion of the grip portion of the handle 102 for this purpose. In the third embodiment, as shown in FIG. 7, the second cam cable anti-vibration bar 700 and the first cam cable anti-vibration bar 600 are respectively coupled at the upper and lower sides of the handle 102, based on the center of the handle 102. Thus, the second cam cable anti-vibration bar 700 attenuates the vibration of the second cam cable 150*a* wound on the cam 200 of the upper pulley assembly 107 at the upper side of the handle 102, and the first cam cable anti-vibration bar 600 attenuates the vibration of the first cam cable 150*b* wound on the cam 200 of the lower pulley assembly 108 at the lower side of the handle 102. Since the second cam cable 150*a* is wound on the cam 200 of the upper pulley assembly 107, the displacement of the second cam cable 150*a* becomes larger in the upper portion of the handle 102, and thus the second cam cable anti-vibration bar 700 supports the second cam cable 150*a* at the upper side of the handle 102. As a result, the third embodiment provides an effect of improving the vibration attenuation property of the second cam cable 150*a* than the case where the second cam cable anti-vibration bar 700 is mounted on the lower side of the handle 102.

Figure 8:
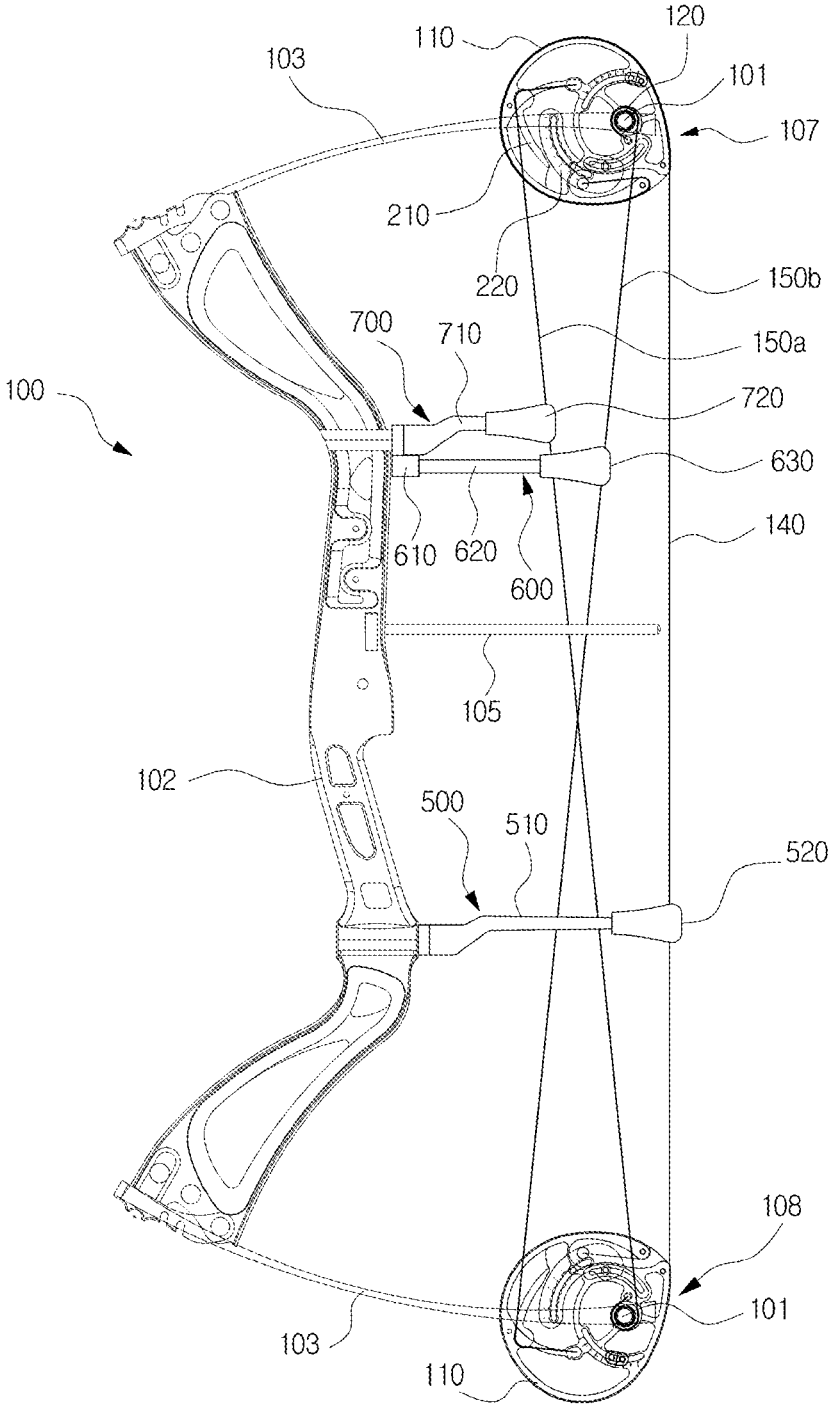
FIG. 8 is a side view showing a case where a first cam cable anti-vibration bar is provided at a different position according to the third embodiment of the present invention.

Meanwhile, FIG. 8 is a side view showing that both the first cam cable anti-vibration bar 600 and the second cam cable anti-vibration bar 700 are mounted at the upper side of the handle 102 in the second embodiment of FIG. 6. In FIG. 8, the connection bar 710 of the second cam cable anti-vibration bar 700 is coupled to the handle 102, and the pivot lever 610 of the first cam cable anti-vibration bar 600 is coupled to the connection bar 710 of the second cam cable anti-vibration bar 700. However, the first cam cable anti-vibration bar 600 may be configured to be coupled to the handle 102, as another example. Other configuration and effects of the compound bow of FIG. 8 are same as those of the second embodiment.

Figure 9:
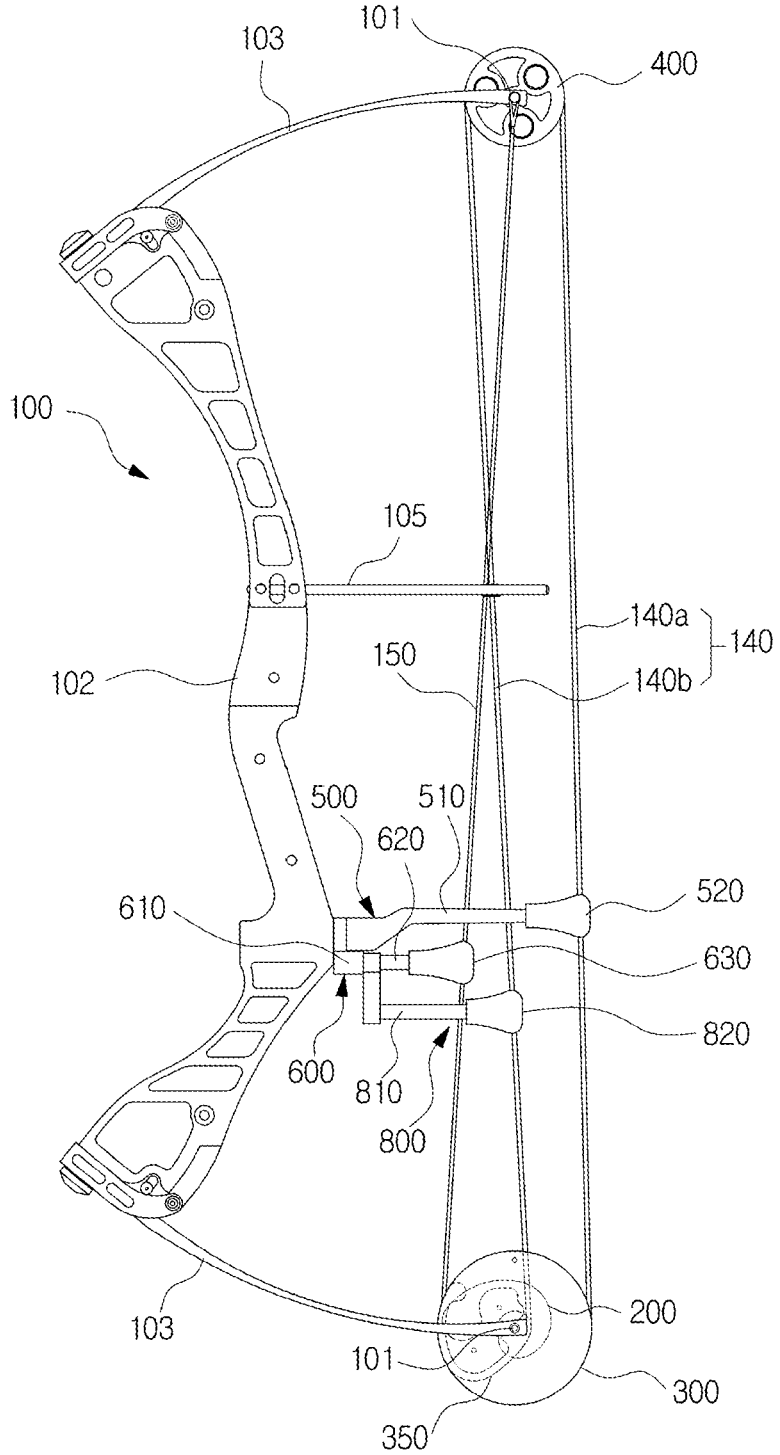
FIG. 9 is a side view showing a compound bow according to a fourth embodiment of the present invention.

Next, a compound bow according to a fourth embodiment of the present invention will be described below in detail with reference to FIG. 9. As shown in FIG. 9, the fourth embodiment of the present invention illustrates the compound bow of the case where the present invention is applied to the compound bow of a single cam mode. The compound bow according to the fourth embodiment of the present invention includes: a bow main body 100 including a handle 102 at a central portion of which a grip portion is formed and a pair of limbs 103 that are respectively coupled to both ends of the handle 102; a main pulley 300 that is rotatably coupled to a rotating shaft 101 that is formed at the rear end of one of the pair of limbs 103; a driven pulley 400 that is rotatably coupled to a rotating shaft 101 that is formed at the rear end of the other of the pair of limbs 103; a bowstring 140 whose one end is coupled to one side of the main pulley 300 and is wound around the main pulley 300, and whose other end is wound on a cable winder 350 that is formed in the main pulley 300 in a state where a middle portion of the bowstring 140 is wound on the driven pulley 400, to thus enable the end of the bowstring 140 to be coupled to the main pulley 300; a cam cable 150 that is wound on a cam 200 that is formed at one side of the main pulley 300 and is rotated with the main pulley 300 when the bowstring 140 is pulled, in which one end of the cam cable 150 is coupled to the rear end of the limb 103 to which the driven pulley 400 is coupled and the other end thereof is coupled to the main pulley 300; a first bowstring support bar 500 whose one end is coupled to the handle 102 and whose other end is coupled to a cushioning member 520 that contacts a part 140*a* of the bowstring 140 pulled for firing an arrow; and a cam cable anti-vibration bar 600 including a coupling bar 620 coupled to the handle 102, and an anti-vibration member that is coupled to the rear end of the coupling bar 620 and whose rear surface contacts the cam cable 150 when the bowstring 140 is released and returns to an original position.

The compound bow according to the fourth embodiment of the present invention will be described below in detail with reference to FIG. 9. In the case of the compound bow of this embodiment, the upper limb 103 is coupled at the upper portion of the handle 102 at the center of which a grip portion is formed, and the lower limb 103 is coupled at the lower portion of the handle 102. The driven pulley 400 and the main pulley 300 are rotatably coupled to the rotating shafts 101, respectively, at the rear ends of the upper and lower limbs 103, and the cam 200 on which the lower end of the cam cable 150 is wound is coupled to the main pulley 300.

One end of the bowstring 140 is coupled to the main pulley 300, the middle portion of the bowstring 140 is wound around the driven pulley 400, and the other end of the bowstring 140 is wound on a cable winder 350 mounted on the main pulley 300, to then be coupled to one side of the main pulley 300.

The upper end of the cam cable 150 is coupled in the form of to a Y-shaped buss cable to the rotating shaft 101 at the rear end of the upper limb 103, and the lower end thereof is coupled to the main pulley 300, in which when the bowstring 140 is pulled, the lower end of the cam cable 150 is wound on the cam 200 that is formed on one side of the main pulley 300 and that rotates together with the main pulley 300.

The cable guard 105 is mounted in the horizontal direction at the center of the handle 102, so as to prevent an arrow from being interfered from being fired, and pushes the cam cable 150 and a part 140*b* of the bowstring 140 in one direction.

The first bowstring support bar 500 is coupled to the lower side of the grip portion of the handle 102, similarly to the first embodiment, and is in contact with the part 140*a* of the bowstring 140 that is pulled by a user during firing of an arrow, in which one end of the first bowstring support bar 500 is coupled to the lower side of the grip portion of the handle 102 and the other end thereof is coupled to the cushioning member 520 made of rubber and being contact with the part 140*a* of the bowstring 140. The bowstring support bar 500 includes: a support bar member 510 coupled to the handle 102; and the cushioning member 520 coupled to the support bar member 510. In the same manner as the first embodiment, a support groove is formed in the longitudinal direction at the rear surface of the cushioning member 520, in which the bowstring 140 is inserted through the support groove when the part 140*a* of the bowstring 140 is released and returns to an original position.

The first cam cable anti-vibration bar 600 is coupled to the lower side of the grip portion of the handle 102, and supports the cam cable 150 when the bowstring 140 is released and returns to the original position, and includes: a pivot lever 610 one end of which is rotatably coupled to the bowstring support bar 500 and the other end of which is coupled to a coupling bar 620; a coupling bar 620 that is coupled to the other end of the pivot lever 610; and an anti-vibration member 630 that is coupled to the rear end of the coupling bar 620, in which the rear surface of anti-vibration member 630 contacts the cam cable 150, when the bowstring 140 is released and returns to an original position. In FIG. 9, an example in which the first cam cable anti-vibration bar 600 is coupled to the first bowstring support bar 500 has been shown in this embodiment, but the pivot lever 610 may be rotatably coupled to the handle 102 as another example, or the coupling bar 620 may be coupled to the handle 102 without the pivot lever 610 as still another example.

In this embodiment, in addition to the first bowstring support bar 500, a second bowstring support bar 800 for damping vibrations of the part 140*b* of the bowstring 140 that is not directly pulled by a user is provided. The second bowstring support bar 800 includes: a connection bar 810 coupled to the first cam cable anti-vibration bar 600; and an anti-vibration member 820 that is coupled to the rear end of the connection bar 810 and whose rear surface contacts a part 140*b* of the bowstring 140 that is extended toward the driven pulley 400 from the cable winder 350 of the main pulley 300 when the bowstring 140 is released to thus return to an original position. Even in FIG. 9, an example in which the second bowstring support bar 800 is coupled to the cam cable anti-vibration bar 600 has been shown in this embodiment, but the connection bar 810 may be directly coupled to the handle 102 as another example.

Similarly to the previous embodiment, even in the case of the compound bow according to the fourth embodiment configured as described above, the part 140*a* of the bowstring 140 is pulled and thus the cam cable 150 is wound on the cam 200, while a cam 200 having an eccentricity rotates. In addition, if the bowstring 140 is released when the cam cable 150 is wound on a portion of the cam 200 that approaches closer to the rotating shaft 101 around the eccentricity, the arrow gains a strong momentum by a strong elastic force of the compound bow that momentarily returns to the original position. Here, the bowstring 140 returns to the original position while the part 140*a* of the bowstring 140 contacts the rear surface of the first bowstring support bar 500, to thereby cancel the vibrations generated from the bowstring 140. Simultaneously, when the cam cable 150 is wound on the portion of the cam 200 that approaches closer to the rotating shaft 101 at the firing state as described above, the cam cable 150 is retracted by a certain distance "d" from the original position similarly as shown in FIG. 5 and when the bowstring 140 is released, the cam cable 150 returns to the original position, and is supported on the rear surface of the cam cable anti-vibration bar 600, to thereby be capable of damping vibrations generated from the cam cable 150.

Further, in this embodiment, when the bowstring 140 is pulled, the part 140*b* of the bowstring 140 that is extended toward the driven pulley 400 from the cable winder 350 of the main pulley 300 is also retracted from the original position while the main pulley 300 rotates, similarly to the cam cable 150, to thus cause a slight displacement to occur. In this case, when the bowstring 140 is released and thus returns to the original position, vibrations are generated from the bowstring 140. However, the part 140*b* of the bowstring 140 returns to the original position, and is supported on the back of the second bowstring support bar 800, thereby damping the vibrations generated in the part 140*b* of the bowstring 140.

Accordingly, even in the case of the fourth embodiment that the present invention is applied to a single cam mode, vibrations that are generated from the part 140*b* that is not directly pulled by a user among the cam cable 150 and the bowstring 140 are also attenuated, to thereby damp the vibrations transferred to the handle 102 and thus further improve the accuracy of the arrow.

Meanwhile, the examples that the present invention is applied to the compound bow of the dual cam mode have been described in the above first to third embodiments, but the present invention may be applied to even a compound bow of a 1 & ½ cam mode. Although not shown in the drawings, in the case that the present invention is applied to a compound bow of a 1 & ½ cam mode, the second cam cable 150*a* is the same as that of the above-described embodiments. However, the upper end of the first cam cable 150*b* is coupled in a Y-shaped buss cable form to the rotating shaft 101 of the upper pulley assembly 107 at both ends of the upper pulley assembly 107, instead of the rotating wheel 120 in the upper pulley assembly 107. Even the case that the present invention is applied to the compound bow of the 1 & ½ cam mode, as described above, may have the same effects as the embodiments described above.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

We claim:

1. A compound bow having an improved vibration damping function, the compound bow comprising:

a bow main body, including a handle having two ends, at a central portion of which a grip portion is formed and a pair of limbs that are respectively coupled to both ends of the handle;

upper and lower pulley assemblies each including a pulley that is rotatably coupled to a rotating shaft formed on a rear end of each limb, and a cam that is coupled to one side of the pulley and is rotated with the pulley;

a bowstring having two ends, whose either end is wound and coupled onto the pulley of each of the upper and lower pulley assemblies;

first and second cam cables that are wound around the cam of each of the upper and lower pulley assemblies as the bowstring is pulled, in which one end of each of the first and second cam cables is coupled to one of the upper and lower pulley assemblies, and a second end thereof is coupled to the other of the upper and lower pulley assemblies or the rotating shaft of the other of the upper and lower pulley assemblies;

a bowstring support bar whose one end is coupled to the handle and whose other end is coupled to a cushioning member that contacts the bowstring; and a first cam cable anti-vibration bar including a pivot lever whose one end is coupled to the bowstring support bar and whose other end is spaced by a predetermined distance from one end, wherein a throughhole is formed at one end of the pivot lever, into which a front end of the bowstring support bar is inserted; a coupling bar that is coupled to the other end of the pivot lever; and an anti-vibration member that is coupled to a rear end of the coupling bar and whose rear surface contacts one of the first and second cam cables when the bowstring is released to thus return to an original position.

2. The compound bow of claim 1, wherein a seating groove into which the first cam cable is seated is formed at the rear surface of the anti-vibration member of the first cam cable anti-vibration bar.

3. The compound bow of claim 1, wherein the anti-vibration member of the first cam cable anti-vibration bar is made of rubber in which the anti-vibration member contacts the first cam cable.

4. The compound bow of claim 1, further comprising: a second cam cable anti-vibration bar including a connection bar coupled to the handle, and an anti-vibration member that is coupled to a rear end of the connection bar and whose rear surface contacts the other of the first and second cam cables when the bowstring is released to thus return to an original position, wherein the second cam cable anti-vibration bar is coupled to an upper side of the handle, and the first cam cable anti-vibration bar is coupled to a lower side of the handle, to thus enable the second cam cable anti-vibration bar to damp vibrations of the second cam cable wound around the cam of the upper pulley assembly and the first cam cable anti-vibration bar to damp vibrations of the first cam cable wound around the cam of the lower pulley assembly.

5. The compound bow of claim 4, wherein the second cam cable anti-vibration bar further includes a connection bar that is coupled to the first cam cable anti-vibration bar, and an anti-vibration member that is coupled to a rear end of the connection bar and whose rear surface contacts the second cam cable of the first and second cam cables when the bowstring is released to thus return to an original position.

6. A compound bow having an improved vibration damping function, the compound bow comprising:

a bow main body including a handle having two ends, at a central portion of which a grip portion is formed and a pair of limbs that are respectively coupled to both ends of the handle;

a main pulley that is rotatably coupled to a rotating shaft that is formed at a rear end of one of the pair of limbs;

a driven pulley that is rotatably coupled to a rotating shaft that is formed at a rear end of the other of the pair of limbs;

a bowstring whose one end is coupled to one side of the main pulley and is wound around the main pulley, and whose other end is wound on a cable winder that is formed in the main pulley in a state where a middle portion of the bowstring is wound on the driven pulley, to thus enable the end of the bowstring to be coupled to the main pulley;

a cam cable that is wound on a cam that is formed at one side of the main pulley and is rotated with the main pulley when the bowstring is pulled, in which one end of the cam cable is coupled to the rear end of the limb to which the driven pulley is coupled and a second end thereof is coupled to the main pulley;

a first bowstring support bar whose one end is coupled to the handle and whose other end is coupled to a cushioning member that contacts a part of the bowstring pulled for firing an arrow; and a cam cable anti-vibration bar including a pivot lever whose one end is coupled to the first bowstring support bar and whose other end is spaced by a predetermined distance from the one end, wherein a throughhole is formed at one end of the pivot lever, into which a front end of the first bowstring support bar is inserted; a coupling bar that is coupled to a second end of the pivot lever; and an anti-vibration member that is coupled to a rear end of the coupling bar and whose rear surface contacts the cam cable when the bowstring is released to thus return to an original position.

7. The compound bow of claim 6, further comprising a second bowstring support bar including a connection bar coupled to the cam cable anti-vibration bar, and an anti-vibration member that is coupled to a rear end of the connection bar and whose rear surface contacts a part of the bowstring that is extended toward the driven pulley from the cable winder when the bowstring is released to thus return to an original position.

* * * * *